US005183366A

United States Patent [19]

Paech

[11] Patent Number: 5,183,366

[45] Date of Patent: Feb. 2, 1993

[54] ROD HANDLER APPARATUS

[75] Inventor: Ivor N. Paech, Christies Beach, Australia

[73] Assignee: Longyear Company, Salt Lake City, Utah

[21] Appl. No.: 621,755

[22] Filed: Dec. 4, 1990

[51] Int. Cl.[5] ..... E21B 19/14

[52] U.S. Cl. ..... 414/22.52; 175/85; 414/22.53; 414/22.55; 414/22.63; 414/728; 414/734; 414/740

[58] Field of Search ..... 175/85; 414/22.52, 22.53, 414/22.54, 22.55, 22.63, 22.65, 22.68, 728, 732, 734, 738, 740, 743, 753, 744.3, 744.8

[56] References Cited

U.S. PATENT DOCUMENTS

| | | | |
|---|---|---|---|
| 2,677,342 | 5/1954 | Miller | 414/728 X |
| 2,828,998 | 4/1958 | Seellye | 414/740 X |
| 3,212,649 | 10/1965 | Johnson et al. | 414/753 X |
| 3,710,954 | 1/1973 | Hutchison | 414/22.55 |
| 4,299,529 | 11/1981 | Inaba et al. | 414/744.3 X |
| 4,345,864 | 8/1982 | Smith, Jr. et al. | 414/22.63 |
| 4,604,724 | 8/1986 | Shaginian et al. | 414/22.55 X |
| 4,715,761 | 12/1987 | Berry et al. | 414/22.65 |
| 4,718,805 | 1/1988 | Becker | 414/22.54 |
| 4,765,401 | 8/1988 | Boyadjieff | 175/85 X |
| 4,951,759 | 8/1990 | Richardson | 414/22.53 X |

FOREIGN PATENT DOCUMENTS

| | | | |
|---|---|---|---|
| WO87/04754 | 8/1987 | PCT Int'l Appl. . | |
| 9006214 | 6/1990 | PCT Int'l Appl. | 414/728 |
| 1411427 | 7/1988 | U.S.S.R. | 414/22.52 |

*Primary Examiner*—Michael S. Huppert
*Assistant Examiner*—Janice Krizek
*Attorney, Agent, or Firm*—Clayten R. Johnson

[57] ABSTRACT

An extendable boom assembly is mounted on a platform or a base for longitudinally pivotally moving a drill rod between a rod rack and a drill rig in a position in alignment with the drill string axis regardless of whether the drilling direction is vertical or is angularly positioned relative to the vertical direction. The boom assembly is mounted for pivotal movement with the track assembly and transverse movement relative thereto, the track assembly being mounted on a drill rig platform. The upper end of the boom assembly mounts a jaw assembly for releaseably gripping a drill rod, the jaw assembly being mounted for limited pivotal movement about a horizontal axis and is of a design not requiring the rods being in a particular spaced relationship relative to one another. The gripping assembly jaws and the limited pivotal movement results in the rod to be transferred being pivoted to a position parallel to the main boom arm central axis as the rod is being clampingly engaged and moved away from the rod stack. The controls are located at a location away from the path of movement of the clamped drill rod.

15 Claims, 7 Drawing Sheets

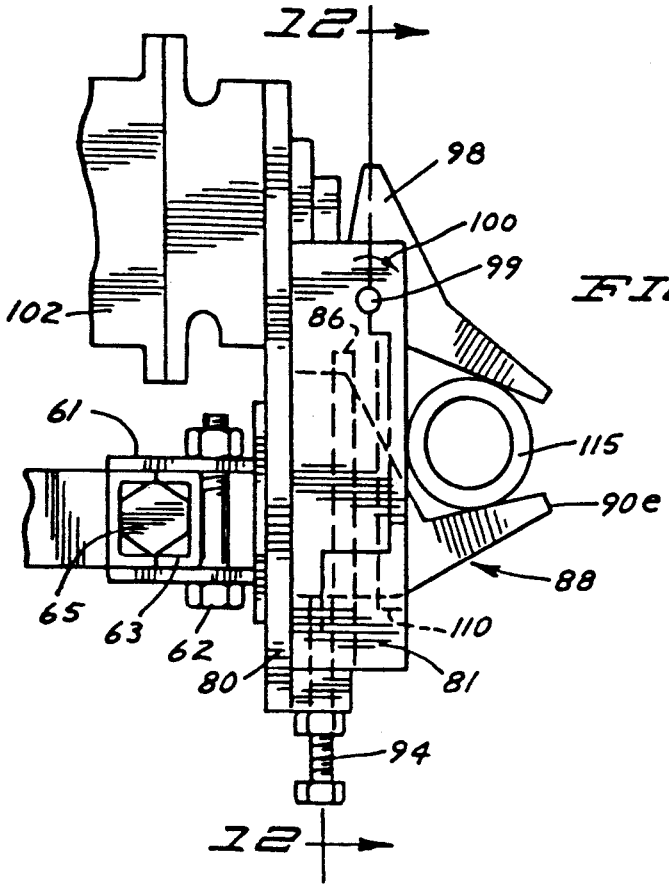
FIG. 8
FIG. 1
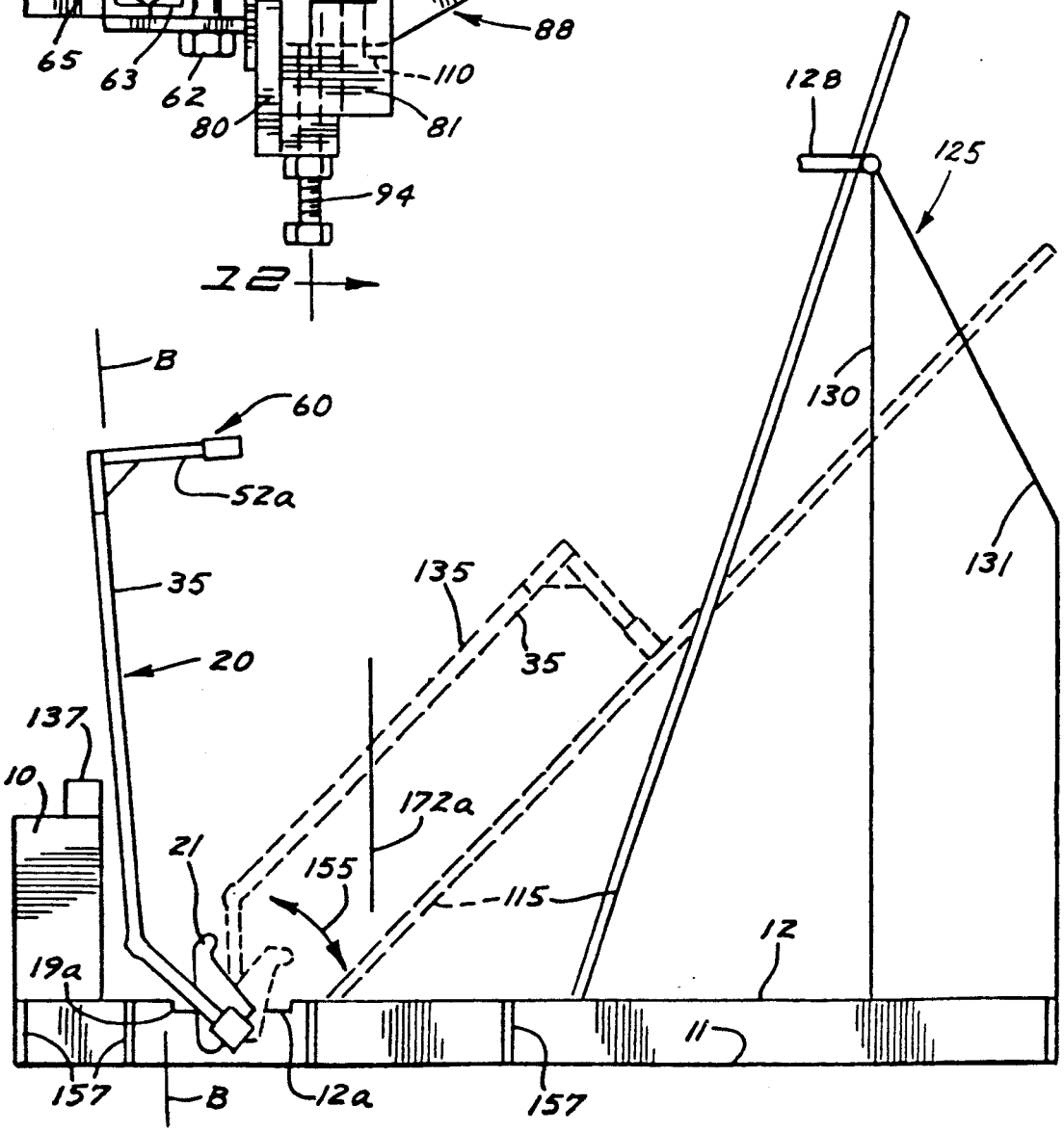

39
28
26
25
27
147
143
140
146
151
22
142
21
23
38
102
37
144
148
149
145
150

131
126
127
128
13
12
11
20
176
12c
136
159
12a
23
21
25
11c
18
16
26
15
30
19c
19a
19

ROD HANDLER APPARATUS

BACKGROUND OF THE INVENTION

Disclosed is apparatus for transferring drill rods between a rod rack and a drill rig in a position for respectively being coupled to and removed from a drill string.

Generally drill rods longer than 3 meters are too heavy to be conveniently manually handled for transferring a rod between a rod stacking area and a position for being coupled to a drill string. Generally in prior art rod handlers, the drill rods must be stored in special arrays (special stacking arrangements) with the stack divided into rows and with the rods separated by at least a predetermined dimension, to be gripped by the rod gripping assembly of a rod handler. When different diameter rods are to be used, adjustments in the stacking array structure has to be made. Further, prior art rod handlers generally require two spaced rod gripping devices to ensure the rod remaining rigid when clamping gripped. Also rotation of a drill rod by a powered swivel action of the gripping devices is required because, other than for rotary turrets or turntables storing rods, usually the bore hole axis is not aligned with the axes of the rods in the rod rack (stacked storage position). To transfer a drill rod from a stacking area to a position in a drilling machine requires a drill rod to be moved in four ways: 1) x axis; 2) Y axis; 3) Z axis; and 4) rotation. International Publication Number WO87/04754 to Jonsson discloses rod handling apparatus having a boom mounted for horizontal movement by a housing that is, in turn, mounted for vertical movement. The boom depending mounts a rod having a rod gripping assembly and control mechanism mounted thereon. This requires the operator to be closesly adjacent to a gripped drill rod. Berry, U.S. Pat. No. 4,715,761, discloses rod handling apparatus for moving a drill rod between a storage position and a bore hole aligned position. The apparatus includes a base that is rotatable about a vertical axis by a motor. The base in turn mounts parallel tracks which mount a carriage for movement by a hydraulic ram. A multisection telescopic boom is carried by the carriage and is pivotable relative to the carriage about a horizontal axis by a piston cylinder. One end of the boom mounts a jaw device for gripping a rod.

U.S. Pat. No. 4,345,864 to Smith, Jr. et al. discloses rod handling apparatus for moving a pipe that includes a turret dependingly mounting a vertical leg. Linkage mechanism is mounted by the vertical leg for translating rod gripping mechanism between two horizontally spaced positions. The rod gripping mechanism includes a pair of power operated jaws mounted for pivotal movement about a vertical axis, the rack having a fingerboard for retaining rows of pipes in spaced relationship.

U.S. Pat. No. 4,269,554 to Jackson includes a table that appears to be reciprocally moved toward and away from the inside of a derrick. The table mounts a transfer arm frame for pivotal movement about a vertical axis while the arm frame mounts a power operated gripping device for gripping rods supported by a fingerboard in parallel relationship to the bore hole axis.

In order to make improvements in rod handling mechanism and overcome limitations encountered by apparatus of the general nature of the above mentioned prior art, this invention has been made.

SUMMARY OF THE INVNETION

The drill rod handling apparatus includes a transverse track assembly mountable on a drill rig platform for mounting and moving a boom assembly pivotally about a transverse axis and transversely along the track relative to the platform. The end of the boom assembly remote from the platform mounts a gripping device assembly for limited pivotal movement about an axis generally parallel to the transverse axis to facilitate gripping of the rods regardless of whether or not the rods in the rack are generally parallely aligned with the bore and/or one another. Further the device jaws are of a shape to move the rods in a rack adjacent to the rod to be gripped away from transversely adjacent rods to facilitate gripping a rod. Advantageously the boom assembly is of an extendable type.

One of the objects of this invention is to provide novel rod handling apparatus for moving drill rods between a rod rack and a drill rig in alignment with the bore hole. An additional object of this invention is to provide novel rod handling apparatus of a relatively simple construction for mechanically moving a drill rod without having to manually munipulate the rod as it is moved between bore hole aligned and rack storage positions or having the controls closely adjacent to the path of movement of the rod.

A still further object of this invention is to provide novel rod gripping mechanism for clampingly gripping a drill rod. In furtherance of the last mentioned object, it is another object of the invention to provide novel means for mounting the gripping jaws for movement relative to the gripping device mounting arm to facilitate gripping rods extending at various angles relative to the drill rig platform and transferring the gripped rod to a position closesly adjacent to the drill stem in alignment with the bore hole axis.

Another object of the invention is to provide a rod handler having novel clamping means for clampingly engaging a drill rod without requiring a special rod stacking array while being able to select any rod at the side of the stack adjacent to the rod handler. An additional object of this invention is to provide novel rod handler means that can accommodate transferring rods of different sizes without requiring changes to the rod stacking system and minimal changes, if any, to the rod gripping assembly.

An additional object of this invention is to provide novel rod handler gripping means having a self aligning feature that forces a rod to move, including automatically rotating, as the rod is clampingly engaged and moved away from the stack to extend parallel to the main boom arm axis of elongation and thereby, when the boom arm has been moved to have the boom arm axis parallel to and in longitudinal alignment with the bore hole axis, support the drill rod in longitudinal alignment with the bore hole. A still another feature of this invention is to provide novel rod handler gripping means that is self-aligning for clampingly gripping and removing rods from a rod stack even though the rods in the stack extend vertically in various angular relationships to one another. In furtherance of the last mentioned object, it is another object of this invention for automatically rotating a rod as the rod is being clampingly engaged.

BRIEF DESCRIPTION OF THE INVENTION

FIG. 1 is a simplified diagrammatic showing of a drill rig, and a rod rack mounted thereon and with the rod handler apparatus of this invention being shown with the boom assembly in one limited position in solid lines and in dotted lines in a position holding a drill rod in alignment with an angular bore hole to be removed from or coupled to a drill string, many parts not being shown;

FIG. 8 is a fragmentary view corresponding to that of FIG. 7 other than it shows the assembly clampingly gripping a rod of a larger diameter;

Figure 2:
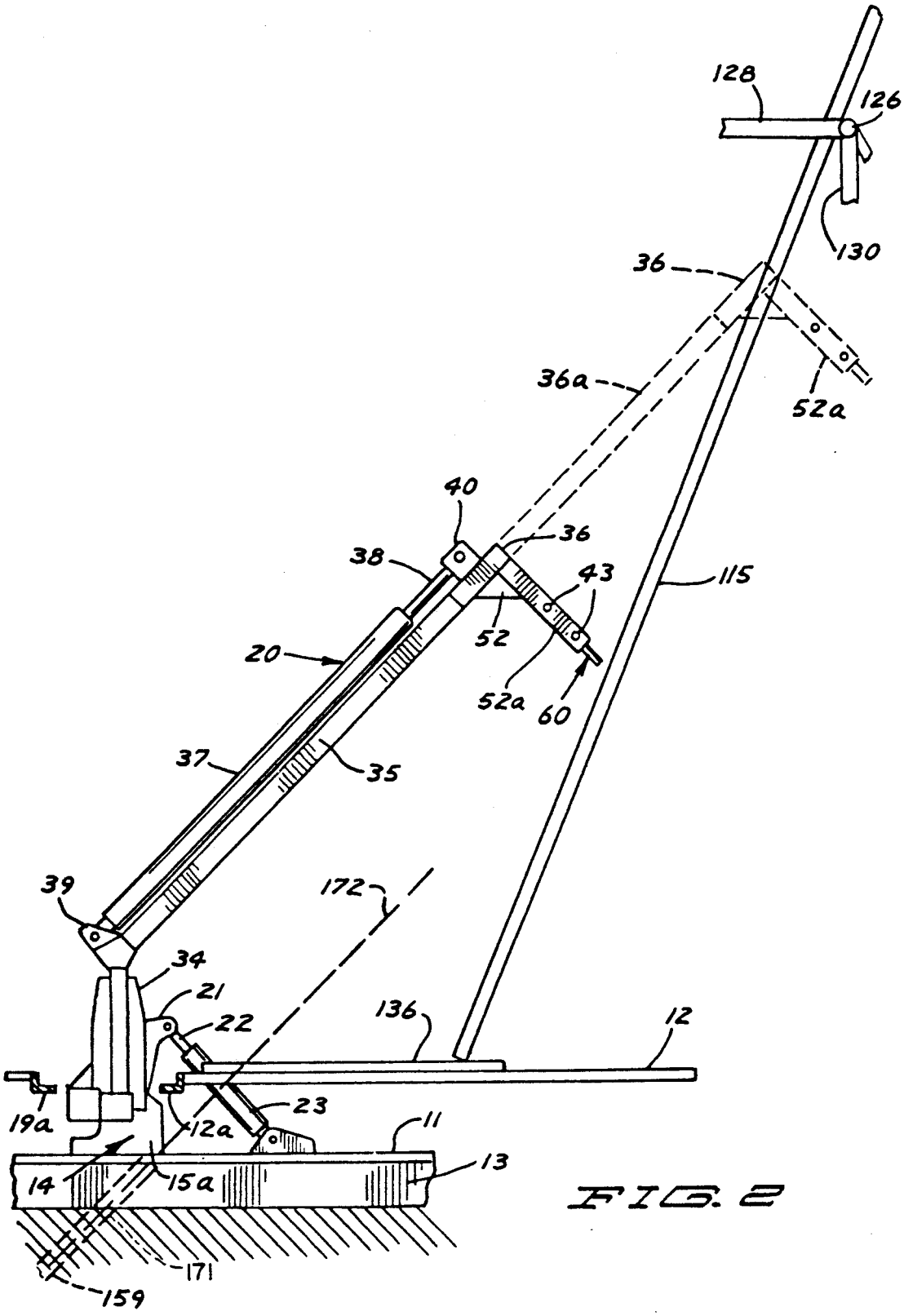
FIG. 2 is a fragmentary showing of part of the structure indicated in FIG. 1 with more details of the boom assembly.
Figure 3:
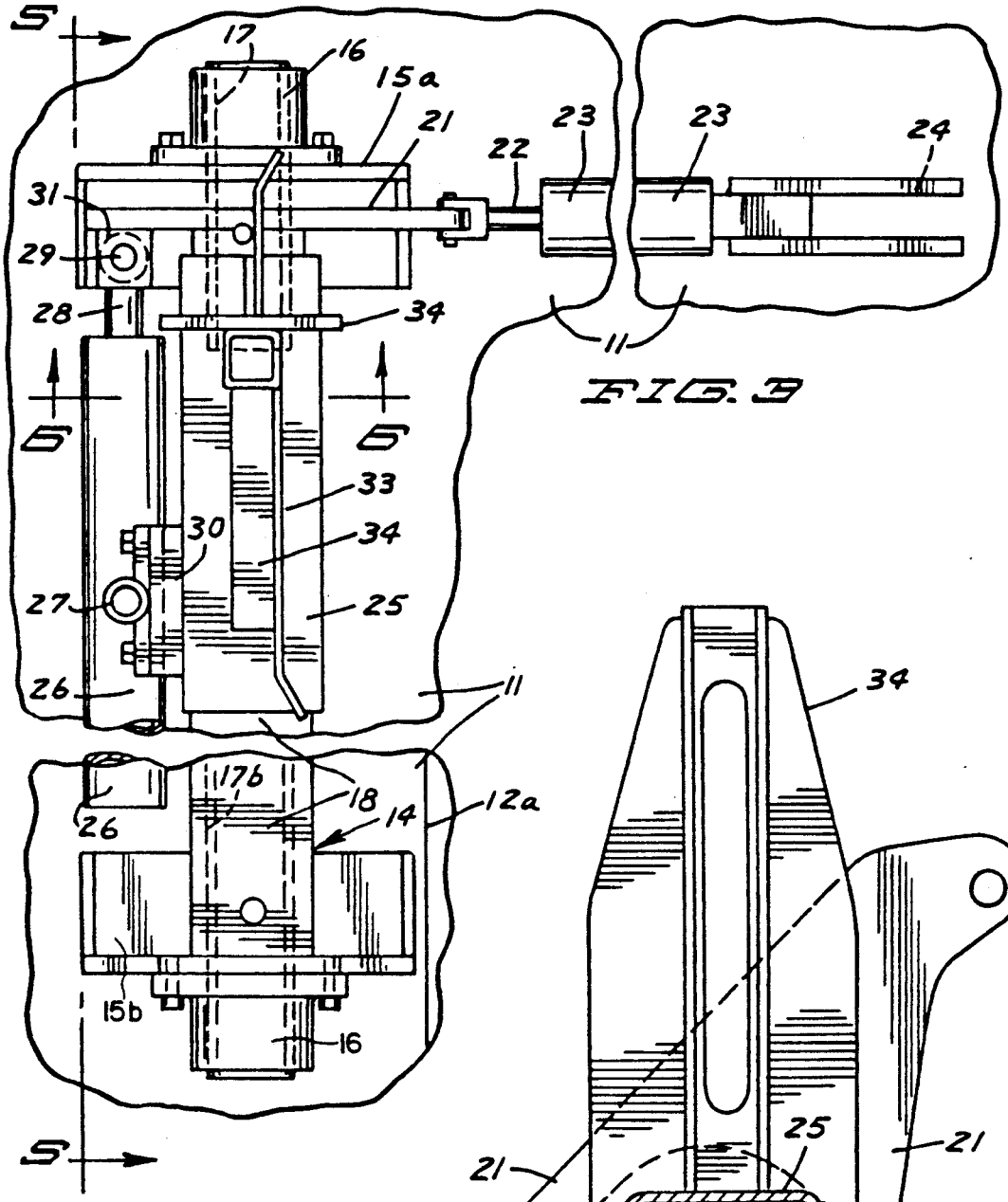
FIG. 3 is a plan view of the track assembly and boom mounting structure with longitudinal and transverse intermediate portions broken away.
Figure 6:
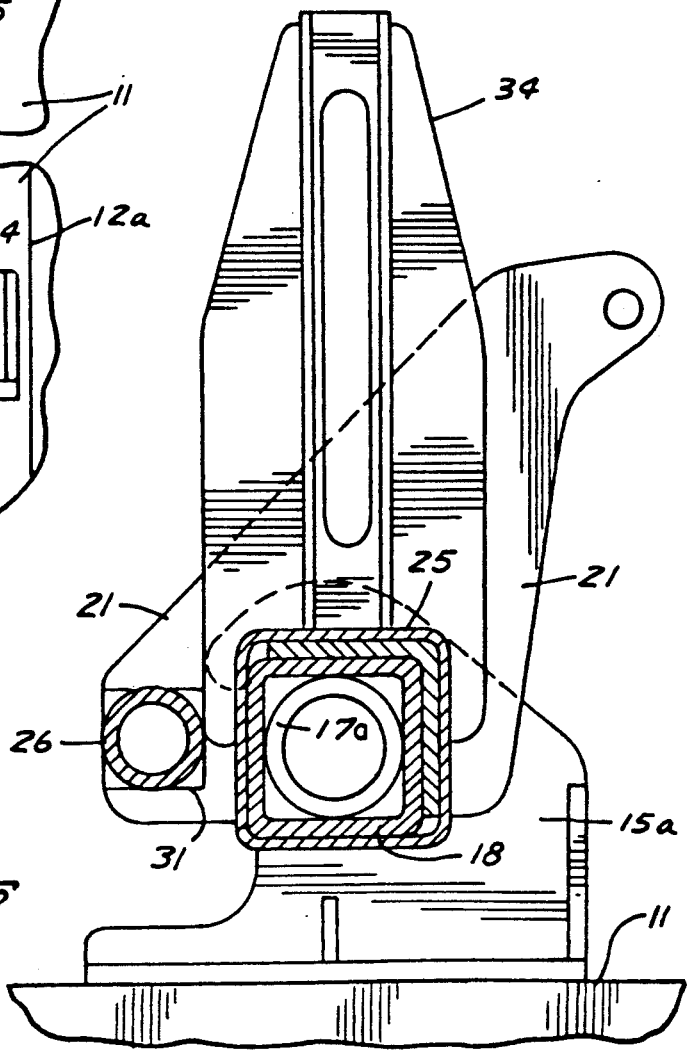
FIG. 6 is a fragmentary longitudinal cross sectional view that is generally taken along the lines and in the direction of the arrows 6—6 of FIG. 3.

Referring in particular to FIGS. 1-4, the rod handler of this invention includes a conventional drill rig (drilling machine) represented by the clock 10 mounted on one of the front or rear decks 12, 19 or a platform (base) 11. The decks are mounted on the platform by frame members 157 while the platfrom is mounted by the beams 13. A transversely elongated track assembly, generally designated 14, of the rod handler of this invention is mounted on the longitudinal rear end portion of the platform and includes transversely spaced track mounts 15*a*, 15*b* mounted to the platform and mounting journals 16. Each journal pivotally mounts a pivot tube 17*a*, 17*b* respectively to have coextensive transverse pivot axes. The pivot tubes have the adjacent end portion of the transversely elongated, rectangular track (slide) channel 18 secured in fixed pivotal relationship thereto.

The pivot tube 17*a* mounts a main pivot bracket 21 in fixed pivotal and transverse relationship relative thereto to extend radially outwardly therefrom, the piston rod 22 of the main boom cylinder 23 being pivotally connected to the radial outer end of the bracket 21. The cylinder is pivotally connected to the bracket 24 mounted on the platform longitudinally forwardly of the bracket 15*a*. The operation of the piston cylinder combination 22, 23 results in the transverse track being pivoted about its transverse axis elongation.

A generally rectangular channel slide 25 is transverely slidably mounted by the track 18 for pivotal movement with the track. For transversely moving the slide along the track there is provided a slide cylinder 26 having its transverse intermediate portion mounted by transverse cylinder pivot 27 that in turn is mounted by block 30 for pivotal movement about an axis that extends at right angles to the direction of elongation of the track and contained in the vertical plane that is perpendicular to the axis of elongation of the track. The block is fixedly secured to the slide 25. The piston rod 28 for the cylinder 26 is connected to a pivot 29 having a pivot axis parallel to pivot 27, the pivot 29 being mounted by tabs 31 that in turn are mounted by the main pivot bracket 21. Thus the piston cylinder combination 28, 26 is provided for transversely moving the slide relative to the track and the platform.

A boom mounting bracket 34 is mounted by the slide to extend generally radially away from the track pivot axis, the bracket mounting a shield 33. The bracket 34 mounts a boom assembly, generally designated 20, for movement therewith, the assembly including a main boom arm 35 which in turn telescopically mounts a boom extension arm 36, the arms having a central axis of elongation B—B. One end of a boom lift cylinder 37 of the piston cylinder combination 37, 38 is pivotally mounted to the lower end of the main arm 35 while the upper end of the extension arm 36 mounts tabs 40 for pivotally mounting the upper end of the piston rod 38 for the boom cylinder.

A boom mounting arm member 52 is mounted to the upper end of the extension arm 36 and includes a mounting arm 52*a* extending longitudinal forwardly (outwardly) of the arm 36 at right angles thereto. Referring in particular to FIGS. 7-11, the mounting arm 52*a* mounts a jaw arm extension 59 that is secured to the arm 52*a* in selected telescopically adjusted positions by fasteners 43 extended through spaced apertures in the mounting arm 52*a* and apertures 58 in extension arm 59 for retaining the extension arm 59 in selected longitudinally adjusted positions relative to main boom arm 35. A gripping jaw assembly, generally designated 60, has transversely spaced pivot plates 61 pivotally mounted by a transverse pivot bolt 62 that is pivotally extended through the end portion 59*c* of the extension arm 59 that is remote from the lift arm extension 36.

Figure 10:
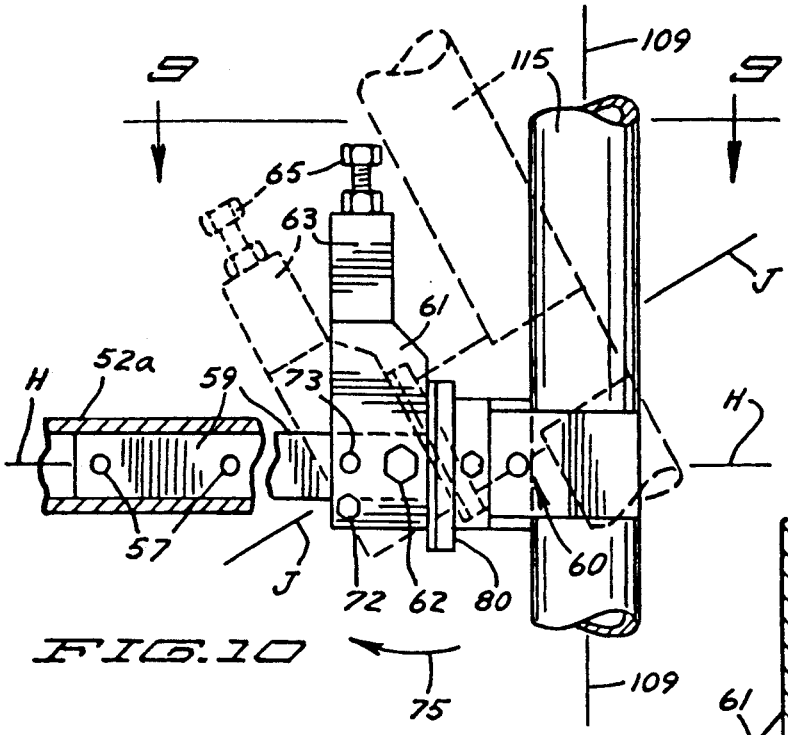
FIG. 10 is a side view of the gripping assembly, other than not showing the jaw cylinder assembly, with the jaws holding a drill rod extending generally perpendicular relative to the jaw extension arm in solid lines and at an angle limited position relative to the jaw extension arm in dotted lines.
Figure 11:
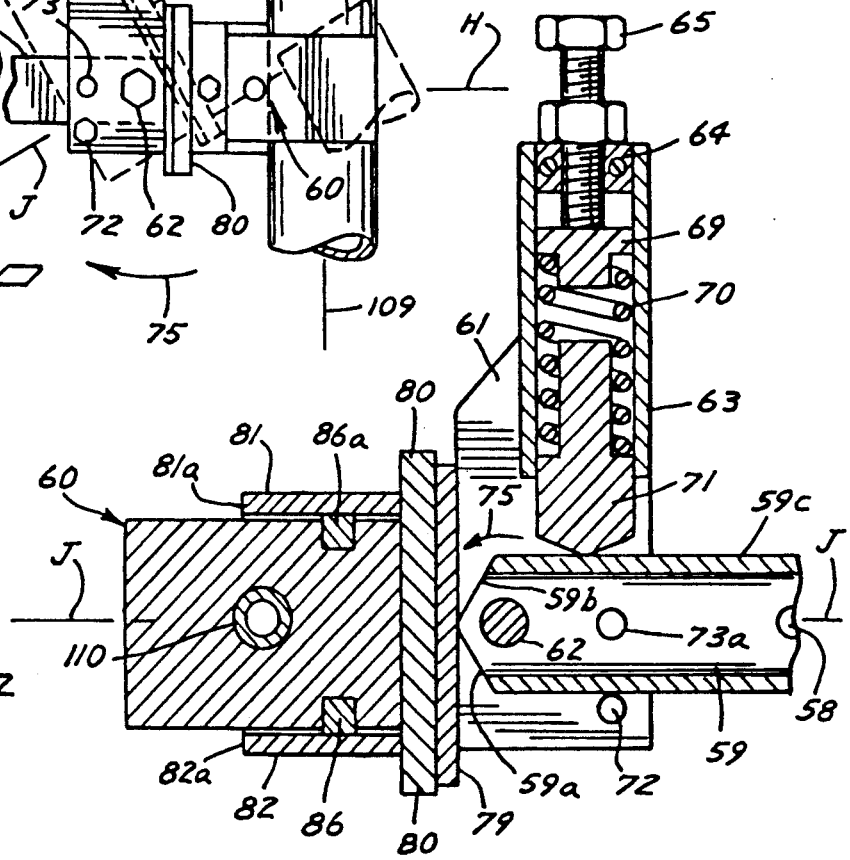
FIG. 11 is a vertical cross sectional view generally taken along the line and in the direction of the arrows 11—11 of FIG. 7.
Figure 12:
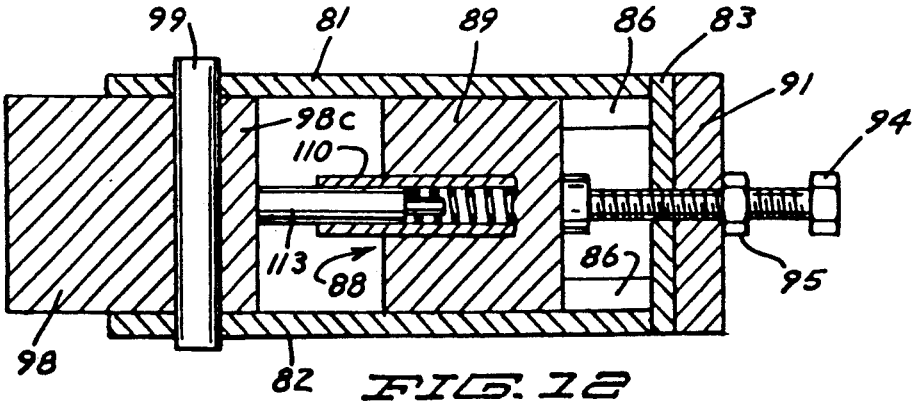
FIG. 12 is a vertical cross sectional view that is generally taken along the line and in the direction of the arrows 12—12 of FIG. 8.

The gripping assembly has a generally longitudinally extending axis H—H that in the assembly datum position is generally coextensive with the axis of elongation of arms 52*a*, 59 and with the stop bolt 72 in abutting relationship to arm 52, and a limited pivot position in the direction opposite of the arrow 75 that has said axis extending at the angle J—J relative to the datum position (see FIG. 10). In the limited pivoted position J—J, the edges 59*b* of the extension arm 59 abut against plate 79 to prevent further pivotal movement of the jaw assembly in the direction opposite of the arrow 75. The axes B—B, H—H, J—J are contained in a common vertical longitudinal plane that is perpendicular to the track transverse pivot axes while the central axis 109 of the drill rod 115 while clampingly retained with the gripping assembly in its datum position may be transversely offset from the common plane, depending upon the transversely adjusted position of the jaw 88, and at least substantially contained in a plane parallel to the common plane.

A plunger channel 63 is mounted by the pivot plates to be located above arm extension 59*c* and extend at right angles thereto, the upper end of the channel mounting a top member 64 that in turn threadedly mounts an adjustment bolt 65 to bear against the upper surface of the spring seat 69 in the channel. The upper end of a spring 70 bears against the seat 69 while its lower end constantly resiliently retains the plunger 71 in abutting relationship to the top surface of the arm extension end portion 59*c*. The spring urged plunger constantly resiliently urges the vertical plates 61 to pivot in the direction of the arrow 75 about pivot 62 from a jaw assembly pivot limited position (axis J—J) in which a plate 79 abuts against downwardly and longitudinally forwardly inclined extension arm edge 59*b* of arm 59 to a position in which the arm 59 is in engagement with the stop bolt 72 which is mounted by the plates 61 below the lower surface of the arm extension portion 59*c* to abut against the lower surface of the portion 59*c* for limiting the pivotal movement in the direction of arrow 75. However the weight of the jaw assembly 60 opposite the pivot 62 from the extension arm 59 is such that the stop 72 remains in contact with the arm extension 59 when the jaws are out of contact with a drill rod. Apertures 73*a* and 73 are provided in the plates 61 and the extension arm 59 to contain a fastener (not shown) for retaining the gripping assembly in its solid line position of FIG. 10, if desired.

Figure 9:
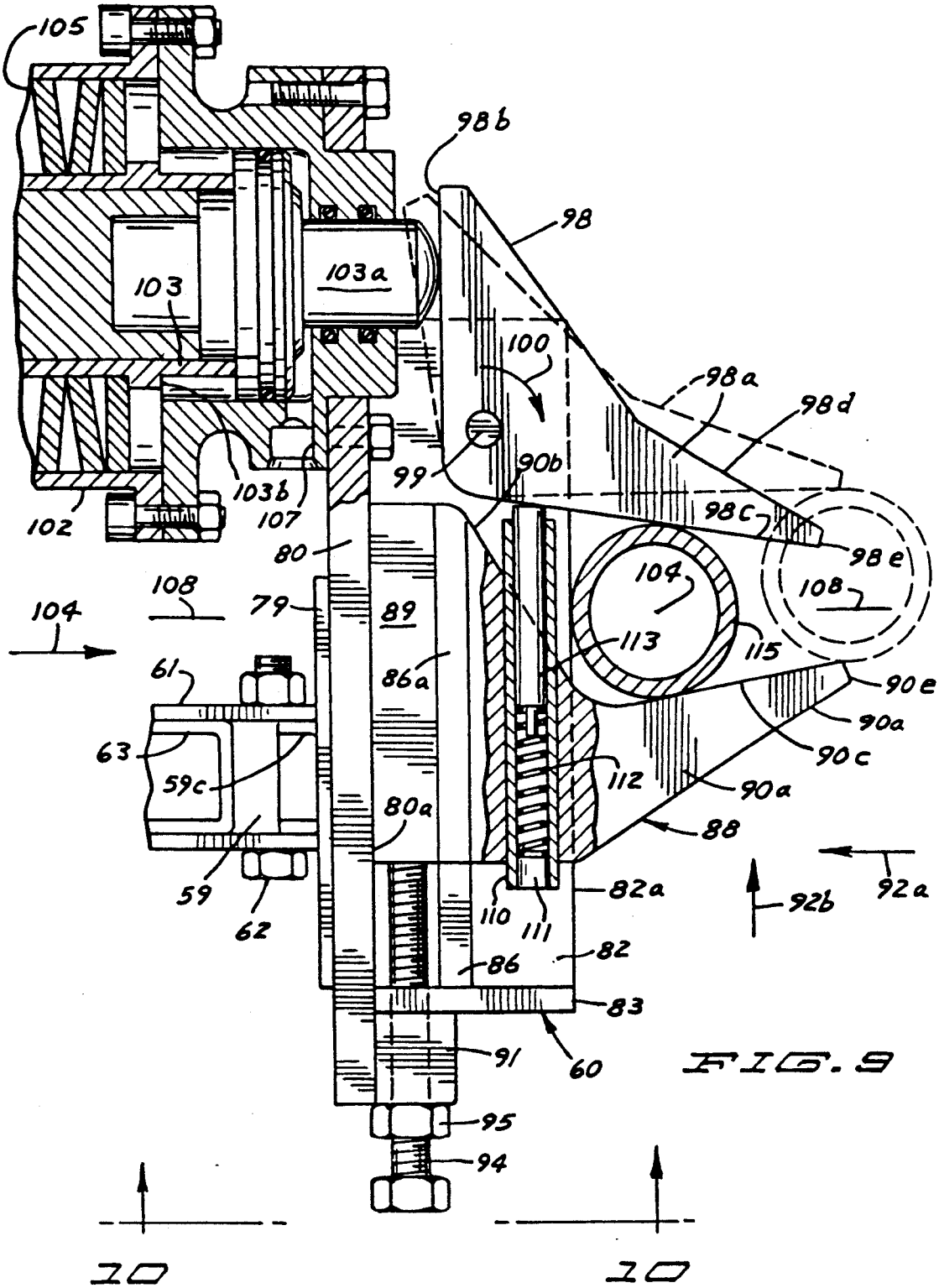
FIG. 9 is in part a plan view of the gripping assembly that is generally taken along the line and in the direction of the arrows 9—9 of FIG. 10 with the top plate of the jaw mount removed, and in part a cross sectional view to show various features of the assembly, the pivot jaw being shown in a rod clamping position in solid lines and a rod release position in dotted lines.

Referring in particular to FIG. 9, the transverse plate 79 is welded to the plates 61 opposite the pivot 62 from the bracket 52, the plate mounting a jaw mount that includes a transverse plate 80 joined to plate 79 and a top, a bottom and an end plate designated 81, 82, 83 respectively joined to plate 80 to extend outwardly therefrom at right angles thereto. Each of the plates 81, 82 mounts a transverse key 86 to extend into the transverse key slots 86*a* in the main body 89 of the transversely adjustable fixed jaw, generally designated 88, to have its finger portion 90*a* extend longitudinally forwardly of the plates 81, 82. A block 91 is secured to end wall 83 for having an adjustment bolt 94 threaded therein for abutting against the fixed jaw to limit jaw movement in the direction opposite of arrow 92*b*, a lock nut 95 being threaded onto the bolt to abut against the block. The bolt is threaded to a position to limit the movement of the fixed jaw 88 toward the end wall 83. That is, for a larger diameter drill rod, the fixed jaw is more closely adjacent to the end wall than for a smaller diameter rod. The jaw 88 is referred to as being fixed since other than for transverse adjustment by threading the bolt 94 in the appropriate direction, the jaw generally remains in fixed position relative to the jaw mount during use.

Transversely opposite the fixed jaw from the end wall 83, a somewhat triangular shaped pivot jaw 98 has its main body portion pivotally mounted between the top and bottom plates 81, 82 by a pivot 99 extending through the apex portion of the jaw. A transverse plunger tube 110 is mounted by the fixed jaw main body 89 adjacent to its juncture to the finger portion 90 and in fixed relationship to the fixed jaw. A spring seat 111 is mounted by the tube opposite the pivot jaw to have one end of a spring 112 abut thereagainst. The spring constantly resiliently urges the plunger 113, which abuts against the generally planar surface 98*c* of the pivot jaw, to urge the pivot jaw to pivot in the direction opposite of arrow 100 about the pivot 99 as a result of the plunger being longitudinally more remote from the mount 80 than the axis of pivot 99.

The pivot jaw has a surface 98*b* that is resiliently retained in abutting relationship to the stud portion 103*a* of the piston member 103 for the cylinder 102 through the resilient action of spring 112. The cylinder 102 is mounted by the mount 80. The cylinder 102 has a port 107 opening to the cylinder chamber for applying fluid under pressure for moving the piston member in the direction opposite of the arrow 104 from its extended position of FIG. 9 retaining jaw 98 in its solid line position to the piston member retracted position permitting the pivot jaw pivotally moving to the dotted line position of FIG. 9 under the action of the plunger mechanism 110–112. A strong string 105 is provided in cylinder 102 and in abutting relationship to the piston member annular shoulder 103*b* to constantly resiliently urge the piston member in the direction of arrow 104 to its extended position for pivoting the jaw 98 with sufficient force to clampingly retain a drill rod between the jaws. The direction of movement of the piston member is perpendicular to the direction of movement of the plunger 113 and to the pivot axis of pivot 99. The central axis of the piston cylinder combination 103, 102 is transversely offset from the pivot axis of the pivot 99 and on the opposite side of the pivot axis from the fixed jaw. With this arrangement, no fluid under pressure has to be applied to piston cylinder combination 103, 102 to retain the jaws in the rod clamping position.

To facilitate the description of the jaws the jaw end portions most longitudinally remote from the mount member 80 will be referred to as the outer ends (outer direction). The vertical generally planar jaw surfaces 90*b*, 90*c* of the fixed jaw extend at an obtuse angle relative to one another while the vertical generally planar surface 90*c* outwardly converges toward vertical generally planar surface 98*c* of the pivot jaw in the pivot jaw release position. Further the surface 90*b* extends outwardly in a direction opposite arrow 92*a* toward the surface 90*c* while the surface 90*c* outwardly converges toward the vertical longitudinal plane 108 that passes through the central axis of the drill rod in a clamped position at a location horizontally transversely intermediate the jaws and in abutting relationship to the stop surfaces 81*a*, 82*a* provided by the transverse front edges of the plates 81, 82. It is to be understood that a longitudinally adjustable stop block (not shown) may be mounted on the jaw mount to extend forwardly of the plate stop surfaces to perform the same stopping function as the stop surfaces. The plane 108 extends perpendicular to the front surface 80*a* of the mount 80. A rounded corner joins surface 90*b* to surface 90*c* adjacent to the front stop edges 81*a*, 82*e* of the top and bottom plates 81, 82.

When the pivot jaw is in its release position its surface 98c advantageously extends at about right angles to the surface 80a of the plate 80 or outwardly diverges from the plane 108 a few degrees, for example 90 to 95 degrees, in an outward direction. Further, when the pivot jaw is in its rod clamping position, the surface 98c extends outwardly in converging relationship to the plane 108, advantageously at an angle of about, for example 70 to 80 degrees relative to surface 80a, the angle of convergence in part depending upon the adjusted position of bolt 94 and in part the outer diameter of drill rod 115. When the jaws are in the rod release position, their outer end portions are transversely spaced by a dimension at least slightly greater than the outer diameter of the drill rod 115 and their planar surfaces 90c, 98c converge in an outward direction. As the pivot jaw moves toward its rod clamping position, the angle of convergence in an outward direction relative to the surface 80a progressively increases to exert a force on the drill rod to move the drill rod inwardly into abutting relationship to the front edges (stop surfaces) 81a, 82a of the plates 81, 82. The jaw mount front edges are at least substantially in a common, generally transversely, predominantly vertical plane that is parallel to the planar front surface 80a of the mount 80, and to the central axis of elongation of the main boom arm when the assembly 60 is in its datum position.

The pivot jaw 98 has an outer finger 98a that includes at least part of the outer part of surface 98c and has a transverse opposite planar vertical surface 98d that converges toward surface 98c in an outward direction. At the finger outer end portion, the surfaces 98c, 98d intersect with the finger portion front edge 98e that is of a dimension substantially less than the outer radius of the drill rod to be clamped and desirably many times less than the outer radius. Similarly the opposite planar surfaces 90c, 90d outwardly converge toward one another to intersect with the front edge 90e that is of a dimension substantially less than that of the outer radius of the rod and desirably many times less than that of the outer radius. Thus the transverse dimensions of each of the edges 90e, 98e is not greater than that of the outer radius of the rod to be transferred, and preferably many less than the radius.

Figure 13:
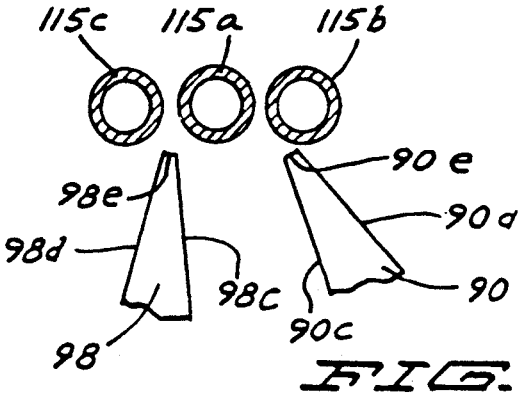
FIG. 13 is a somewhat diagrammatic view showing jaw features for moving rods apart to facilitate clampingly gripping a rod supported by a rod rack.

As in part depicted in FIG. 13, when the jaws are in their release position, the minimum transverse spacing of the edges 90e, 98e is greater than the outer diameter of the drill rod to be picked up while the maximum transverse spacing is substantially less than twice that of the outer diameter of the drill rod and desirably less than one and one-half times that of the outer diameter. As a result, even if the drill rods 115b, 115c on transverse opposite sides of the rod 115a to be clampingly engaged are in abutting relationship or closely adjacent to the rod 115a, the jaws in being moved longitudinally forwardly will force the rods 115b, 115c transversely away from rod 115a sufficiently that over half of the adjacent horizontal transverse cross section of the rod 115a is located between the jaws. Thence, if the front edges of the plates 81, 82 are not in abutting relationship to the rod 115a, due to the outward convergence of the jaw surface 90c, 98c, as the jaw 98 is pivoted relative to jaw 88 to its clamping position, the rod 115a is moved into abutting relationship to the front edges, even if the jaws are not moved further longitudinally forwardly, as a result of the jaw assembly pivoting relative to the pivot 62 and/or the rod pivoting relative to the jaws.

As a result of the jaws being operated to the rod clamping position, the rod is moved to abut against the stop surfaces 81a, 82a and the opposite ends of the rod being transversely moved, if necessary, whereupon the central axis of the clamped rod is parallel to the pivot axis of pivot 99. This provides a self-aligning feature.

When the rod in the stack is being clampingly engaged with the rod inclined such that the rod central axis intersects the base rearwardly of the pivot axis of the pivot 99 intersection with the base, as the rod is moved inwardly toward the stop surface, the rod will pivot about generally transverse axes and the assembly 60 will pivot from the datum position about the pivot 62 (assembly 60 free pivoting feature). Upon elevating the drill rod the assembly will pivot back to its datum position whereupon the gripped rod rotates relative to the main boom arm to be parallel to the boom arm axis B—B. Thus the rod automatically rotates to a position in alignment with the boom arm axis as the rod is clampingly gripped and moved away from the stack. This permits the rods in the stack (rod rack) being at various angles relative to one another and still automatically moving into alignment with the main arm axis as a rod is being clampingly gripped and moved away from the stack by the assembly 60.

Figure 14:
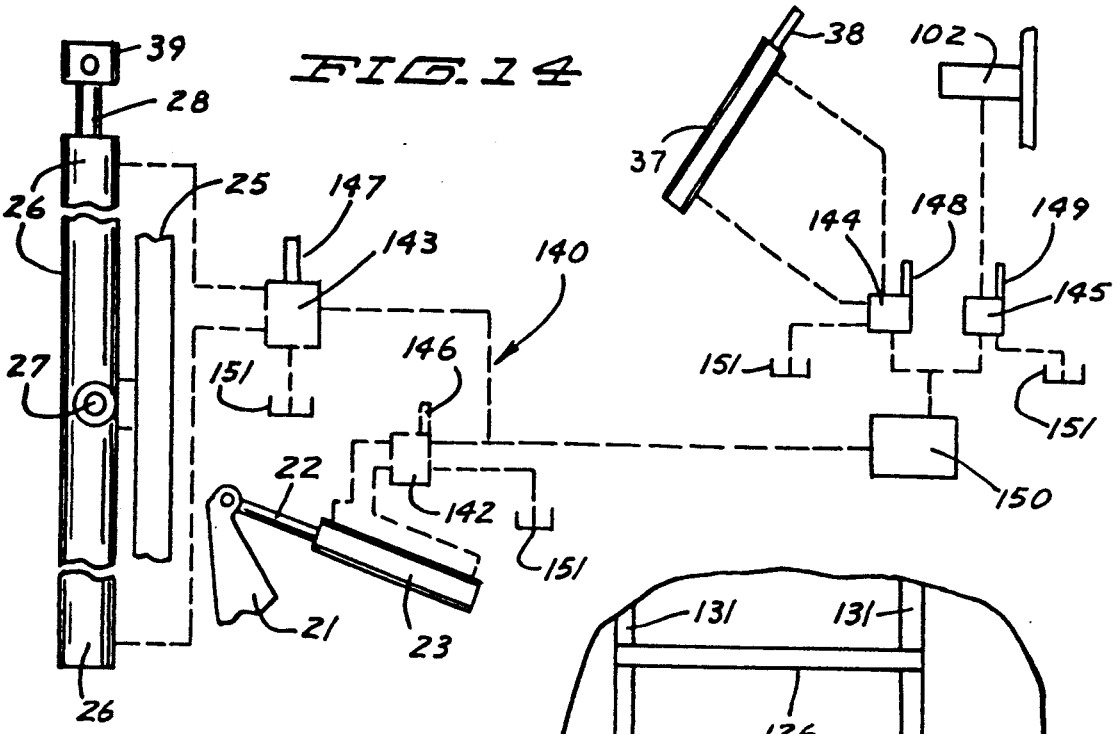
FIG. 14 is a simplified showinging of controls for the rod handler of this invention.

Referring to FIG. 14 a simplified control system, generally designated 140, includes a two way valve 143 for alternately connecting a source of fluid under pressure 150 to opposite ends of the slide cylinder 26 for moving the boom assembly in the desired transverse direction and returning fluid to the sump 151. Similarly a two way valve 142 is provided for alternately connecting the source 150 to opposite ends of the track pivot cylinder 23 for pivoting the boom assembly about the track transverse axis in the desired one of the directions of the arrow 155 and the opposite direction and returning fluid to the sump 151. Also a two way valve 144 is provided for alternately connecting the source 150 to opposite ends of the lift cylinder 37 for selectively raising and lowering the jaw gripping assembly and returning fluid to the sump 151. The port 107 of the cylinder of the jaw gripping assembly 60 is alternately connected to the source 150 and the sump 151 by the way of a grip valve 145. The valves 142, 143, 144, 145 are controlled by the manually operated controls 146, 147, 148, 149 respectively for controlling fluid flow through the respective valve. Preferably the controls 146–149, which are collectively designated as 137 in FIG. 1, are located at a convenient location rearwardly of the track so as to be out of the path of movement of the drill rod being transferred.

Figure 4:
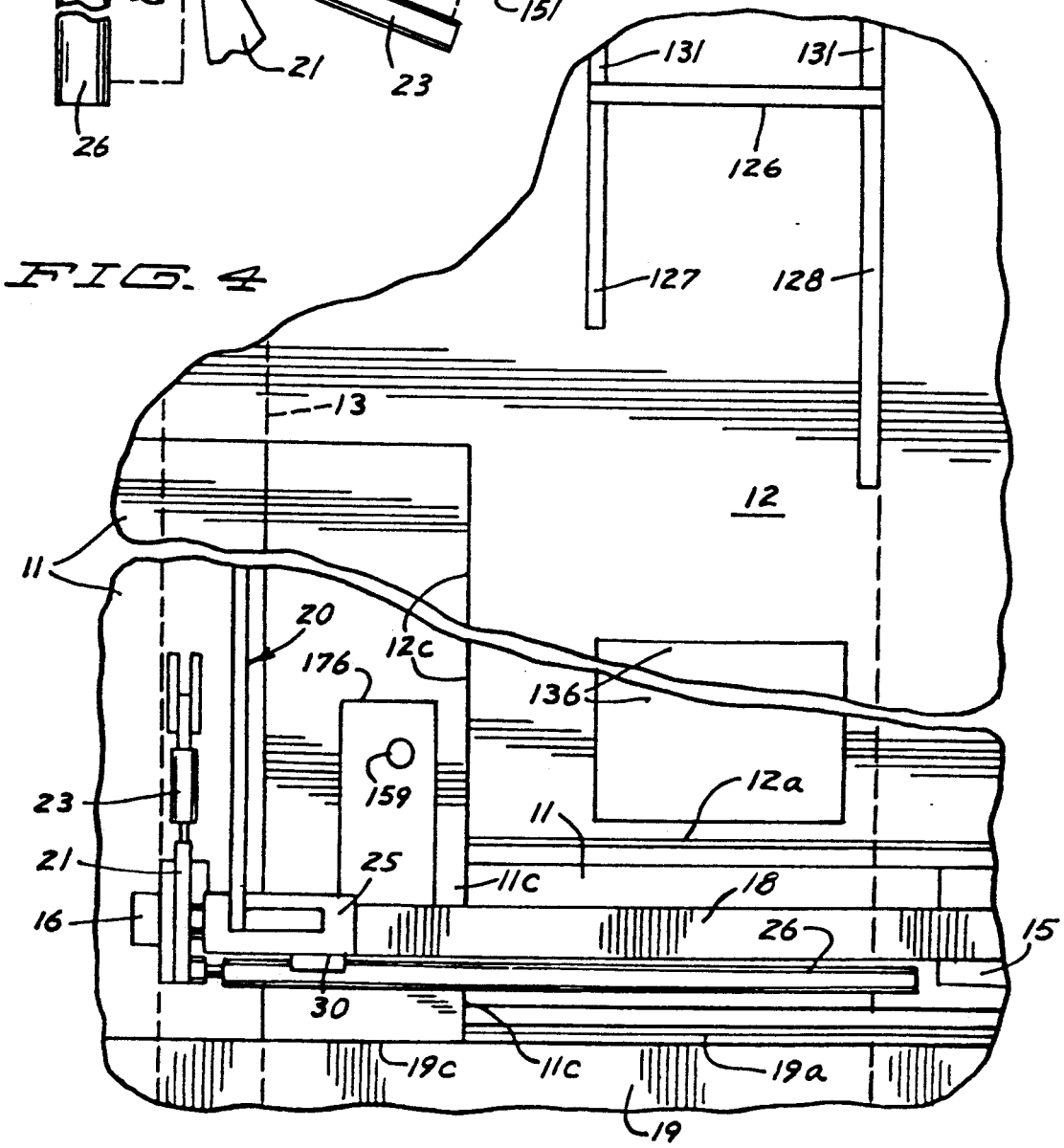
FIG. 4 is a somewhat diagrammatic fragmentary plan view of the structure of FIG. 3 with portions of the plateform and rod rack being broken away.
Figure 5:
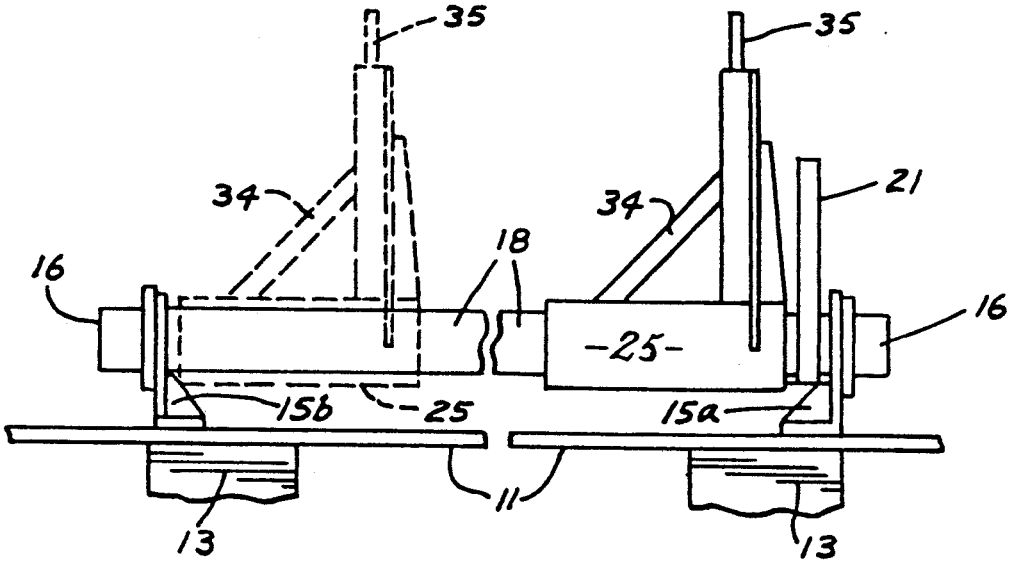
FIG. 5 is a fragmentary end view of the structure of FIG. 3 that is generally taken along the line and in the direction of the arrows 5—5 of FIG. 3 showing the boom mounting bracket in one transverse limited position in solid lines and in the other transverse limited position in dotted lines which is the same as that shown in FIG. 3.
Figure 7:
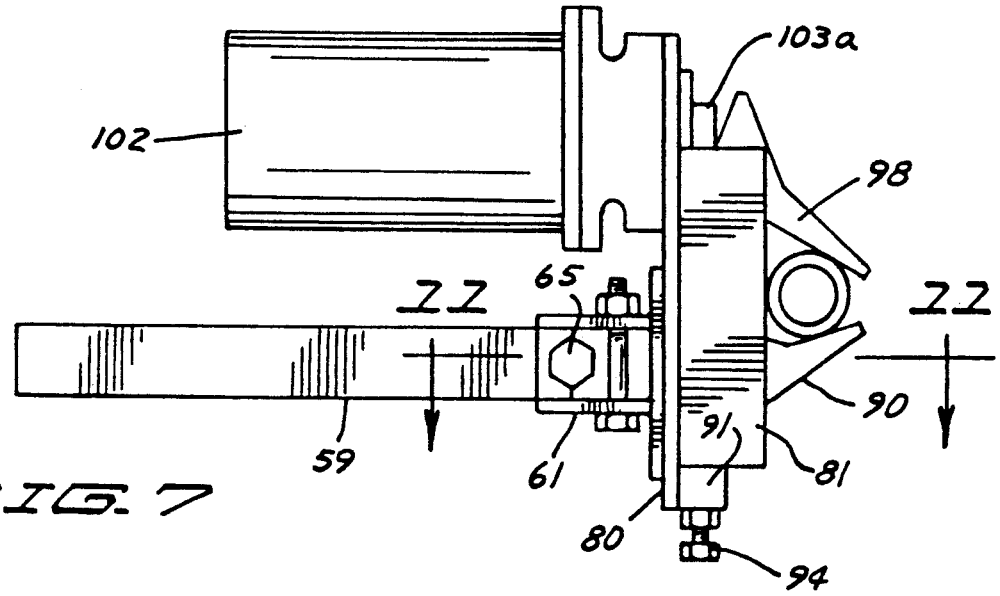
FIG. 7 is a plan view of the rod gripping assembly in its rod clamping position.

Referring in particular to FIGS. 1, 4 and 5, the platform 11 is mounted on beams 13 and mounts frame members 157 of any suitable construction that in turn mount the front and rear decks 12 and 19 respectively. The decks have longitudinally adjacent edges that mount transverse angle irons 12a, 19a on longitudinally opposite sides of the track for supporting a suitable cover member (not shown) extending over the major part of the track assembly when the transfer slide is in the position of FIG. 3 and the rod handler is not being used. A drill rod rack, generally designed 125, is suitably mounted on one of the decks, platform, frame members or adjacent thereto forwardly of the track assembly for supporting drill rods in an inclined position. The rack includes vertically extending frame members 130, 131 that mount a transversely elongated, generally horizontal tube 126 at a substantially higher elevation than the deck 12 and a substantial distance longitudinally forwardly of the track assembly. The rack also includes longitudinally elongated rods 127, 128 in transversely spaced relationship that at their front ends are joined to the opposite ends of the tube 126. The rack may include other members that are not shown or described and not pertinent to the present invention.

Longitudinally between tube 126 and the track assembly and in longitudinal alignment with the tube 126 is a mat 136 or other material on the deck 12, or as a part of the deck, of a hardness sufficiently soft so as not to damage the ends of the stacked drill rods while supporting the lower ends of the rods. The rods are also in part supported by the rack 125 to be upwardly inclined in a direction longitudinally forward of the mat and track assembly. Usually the rods are stacked such that the plane of the edges 81*a*, 82*a* extends to intersect the platform rearwardly of the lower ends of rods. The deck 12 has a cut out 12*c* to have the bracket 21 extend upwardly therethrough and provide access to the drill string 171, while the platform 11 has a cut out 11*c* opening to cut out 12*c* for having the drill rod extend therethrough and connect to the drill string 171, and may open to a conventional face clamp represented by a block 176 for selectively clampingly engaging the drill string.

It will be assumed that the rod gripping assembly is in its release position, that the stop bolt abuts against the arm extension 59, and is of a spacing from the main boom arm central axis B—B that when clampingly retaining a picked up drill rod, the drill rod central axis 109 is of the same perpendicular spacing from the main boom arm central axis as the spacing of the boom arm central axis from the bore hole central axis 172 (FIG. 2) when the picked up rod is closely adjacent to a position for being coupled to the drill string by the drilling machine. It is noted that the showing of the bore hole central axis 172 is an example of angle hole drilling while the showing of the bore hole central axis which is indicated by the line 172*a* is a showing of the vertical downwardly drilling.

Further, assuming the boom assembly is in the solid line position of FIG. 2, the drill rod 115*a* which is being supported by the rack 125 is to be transferred to be coupled to the drill string 159 extending into a bore hole 171, which may be downwardly inclined, and has the central axis 172, and the boom slide 25 is in the dotted line position of FIG. 5 adjacent to the bracket 15*b*, the valve 143 is operated for applying pressurized fluid to the end of the cylinder 26 adjacent to bracket 15*b* for moving the boom assembly transversely to a position longitudinally aligned with the drill rod to be picked up from the rod rack, provided the gripping assembly in being transversely moved will not contact a drill rod. The valves 144, 142 are operated to apply pressurized fluid to the lower end of cylinder 37 to elevate the boom extension 36 to the desired elevation (advantageously adjacent to the vertically central portion of the drill rod) and to the lower end of the cylinder 23 to pivot the track assembly so that the gripping assembly remains longitudinally rearwardly of the driil rods at the same elevation and adjacent thereto until the gripping assembly is at the desired elevation. Then valve 142 is operated to move the gripping assembly forwardly until at least the rear half of the transverse cross section of a drill rod is transversely between the gripping jaws, pushing aside the adjacent drill rods, if necessary, such as described with reference to FIG. 13.

Now the valve 145 is operated to discharge pressurized fluid from the chamber of cylinder 102 whereupon the spring 105 moves the piston, including its piston stud 103*a*, to pivot the pivot jaw toward its closed position against the resilient action of spring 112. As the jaw 98 moves toward its closed position, in the event the central axis of rod 115*a* is inclined downwardly with the lower end of the drill rod longitudinally rearwardly of the plane of the edges, 81*a*, 82*a*, as the pivot jaw moves toward its clamping position, and the rod is moved into abutting relationship with the edge 82*a* the jaw assembly automatically pivots in the direction opposite arrow 75 about pivot 62 relative to the jaw assembly extension arm 59. As a result, the jaws pivot about pivot 62 relative to the drill rod 115*a* to a position that the drill rod snaps against the edges 81*a*, 82*a* to have the central axis 109 parallel to the plane of the edges 81*a*, 82*a*. During the movement of the pivot jaw toward its clamping position and the pivoting of the rod 115*a* and jaw assembly, the rod is forced to move relative to the jaws to be pivoted through predominantly vertically and transversely extending planes about predominantly transversely extending axes and through predominantly vertically and longitudinally extending planes through predominately longitudinally extending axes to have the rod axis and the pivot axis of pivot 99 parallel to one another. As a result, during the rod pick up and clamping operations as in part referred to below, the rod 115*a* is rotated by the pivotal movement of the jaw assembly about pivot 62 and is moved by the pivot jaw moving to the jaw clamping position for automatically aligning the picked up rod to be parallel to the main boom arm central axis and contained in longitudinal vertical plane that is perpendicular to the central axis of the transverse track. With the drill rod abutting against the stop edges of the plates 81, 82 and the jaws in their closed position, valves 144 and 142 are operative to elevate the drill rod off the mat 136 and the track pivoted to move the gripping assembly rearwardly. As the drill rod is thus moved, in the event the arm 59 is not in abutting engagement to the stop bolt 72, the jaws pivot in the direction of the arrow 75 until the stop bolt does abut against the extension arm 59. The jaws are of sufficient thickness that when the jaws are in their rod clamping position, the drill rod will be firmly held against the plates 81, 82 to prevent movement in vertical longitudinal and transverse planes relative to the plates. During the time the pivot jaw moves toward its clamping position, the jaw moves the plunger 113 to further compress the spring 112.

After the drill rod 155*a* is clampingly gripped, the controls are operated to move the boom assembly to move the rod into alignment with the axis 172 of the bore hole, the extension arm 59 having been previously adjustably connected to the arm 52*a* for properly spacing the jaws relative to the main boom arm. For releasing the drill rod after being properly aligned with the drill string, fluid under pressure is applied through port 107 for retracting the piston member whereupon the resiliently urged plunger 113 forces the jaw 98 to pivot in the direction opposite arrow 100 to pivot the pivot jaw to the dotted line retracted position of FIG. 9. Thence the controls may be operated to move the boom assembly to the desired position.

As above indicated, if the rod 115*a* to be picked up in the rod rack has its lower end on one transverse side of a longitudinal vertical plane that is perpendicular to the track transverse axis and the upper end is on the opposite side, as pivot jaw is moved toward its clamping position, rod 115*a* is moved by the pivot jaw to have the rod axis in parallel relationship to the vertical plane. In the event the rod in the rack that is referred to in the proceeding sentence has its lower end rearwardly of the intersection of the axis of pivot 99 with the deck or mat and the transverse plane of the rod axis is out of parallel alignment with the corresponding plane of the axis of the pivot 99; during the period of time that the pivot jaw moves as indicated in the above sentence, the rod is rotated until its axis is parallel to the axis of pivot 99 and in abutting relationship to the stop surfaces which may result in the assembly 60 pivoting away from its datum position. In the event the assembly has pivoted away from its datum position, as the assembly 60 is moved away from the rod rack, the assembly pivots back to its datum position.

The drill rod rack may be mounted on any suitable structure instead of that described, as long as the rod handler can be operated as described. Further the rod handler may be mounted on structure other than that specifically referred herein as long as the rod handler of this invention may operate as herein described.

Instead of using a piston cylinder combination for transversely moving the slide, a nut can be secured to one of the slide and the bracket 34 in fixed relationship thereto and a powered rotated screw mounting the nut for selectively transversely moving the nut, the nut and screw not being shown.

Even though in the above, the invention has been described as transferring one drill rod at a time, each of the drill rods in the rod stack advantageously may be two or more drill rods having axially adjacent ends threadedly coupled together.

What is claimed is:

1. A rod handler apparatus for selectively transferring a drill rod from a first position in a stack in a rod rack to a second position substantially aligned with a bore hole, said drill rod having a central axis of elongation, said rod handler apparatus comprising:

a base having a longitudinal axis, the base including a rear end portion that is adjacent to the bore hole and a front end portion that is longitudinally spaced from the rear end portion and is adjacent to the rod rack, the stack of drill rods supported in the rod rack having the rod central axes inclined to extend upwardly and longitudinally forwardly relative to the base;

a generally horizontally extending, elongated track assembly, the track assembly including an elongated track having a generally horizontal pivot axis extending transversely relative to the base, said track being elongated in a transverse direction relative to the base;

a slide mounted on the track for generally horizontal movement relative thereto in the direction of the track elongation and pivotal movement with the track;

a boom assembly having a central axis of elongation, said boom assembly having a lower end portion mounted to the slide in fixed relationship thereto and an upper end portion;

first selectively operated powered means connected to the slide for selectively moving the slide transversely along the track, and second selectively operated powered means mounted to the base and connected to the track for pivoting the track about the track transverse pivot axis between a boom assembly rod pick up position and a boom assembly rod release position;

gripping means operative between a rod gripping position to clampingly engage a drill rod in the stack when the boom assembly is in its rod pick up position, and a rod release position when the boom assembly is in its rod release position, said gripping means being moved upwardly and rearwardly relative to the base during the movement of the boom assembly from the boom assembly rod pick up position to the boom assembly rod release position; and first mounting means for mounting the gripping means to the boom assembly upper end portion for movement therewith, said first mounting means having a pivot axis generally parallel to the transverse pivot axis;

the gripping means and first mounting means having cooperating means for moving, including rotating, a drill rod relative to the boom assembly to align the drill rod axis to extend parallel to the boom assembly axis in the event the drill rod axis is out of parallel alignment with the boom assembly axis as the drill rod is being clampingly engaged and moved upwardly and away from the rack, the gripping means comprising only one rod gripping jaw assembly.

2. The apparatus of claim 1 wherein the second powered means includes a first bracket attached to the track in fixed relationship thereto, a second bracket mounted to the base in fixed relationship thereto, and a piston cylinder combination connected between the first and second brackets for pivoting the first bracket about the transverse pivot axis.

3. The apparatus of claim 1 wherein the boom assembly includes an elongated main boom arm mounted to the slide in fixed relationship thereto and having a boom arm axis of elongation, and an extension arm mounted by the boom arm for extended and retracted movement relative to the boom arm along the boom arm axis and third selectively operated powered means for moving the extension arm relative to the boom arm between extended and retracted positions.

4. The apparatus of claim 1 wherein the jaw assembly has a jaw assembly axis which extends in a generally longitudinal direction relative to the base and is generally transversely aligned with the boom assembly, said jaw assembly being movable between a datum position and a limited pivot position, the cooperating means including an elongated mounting arm member having an axis of elongation and extending away from the boom assembly in a direction toward the rod rack, the mounting arm member having a first end portion attached to the boom assembly and a second end portion remote from the boom assembly, a jaw mount, pivot means connecting the jaw mount to the mounting arm second end portion for pivotal movement about a generally horizontal axis between a first pivot position in which the jaw assembly axis in the jaw assembly datum position extends generally in the same direction as the arm member axis, and a jaw assembly second pivot position in which the jaw assembly axis extends generally upwardly and longitudinally forwardly relative to the arm member axis, the pivot means axis extending in a generally transverse direction relative to the base, and stop means for limiting the pivotal movement of the jaw assembly relative to the mounting arm member to the jaw assembly datum position when the jaw assembly pivots in a direction from the jaw assembly second position toward the datum position.

5. The apparatus of claim 4 wherein the jaw assembly includes a generally planar stop surface extending generally perpendicular to the jaw assembly axis for limiting the movement of a drill rod toward the cooperating means pivot means, and operable jaw means movable between a rod clamping position and a rod release position for moving the drill rod into abutting relationship to the stop surface and, in moving to its clamping position, causing the jaw assembly to pivot away from the datum position, if necessary, to have the drill rod axis extend parallel to the stop surface as the jaw means is moved to its rod clamping position to clampingly engage a rod in the rod stack, the jaw means being mounted by the jaw mount to extend longitudinally forwardly of the stop surface and the jaw mount.

6. The apparatus of claim 5 wherein the jaw means includes a first jaw, a jaw pivot mounted by the jaw mount to extend parallel to the stop surface and at right angles to the pivot means axis and a second jaw mounted by the jaw pivot for pivotal movement relative to the first jaw between the jaw means rod release and jaw means rod clamping positions.

7. The apparatus of claim 5 wherein the second power means includes a bracket joined to the track in a fixed rotational relationship and a first piston cylinder combination connected between the bracket and the base for selectively pivoting the track about the track transverse pivot axis, and the first powered means comprises a piston cylinder combination connected between the bracket and the slide for selectively moving the slide along the track.

8. A rod handler apparatus for selectively transferring a drill rod from a first position in a stack in a rod rack to a second position substantially aligned with a bore hole which has a central axis comprising:

a base having a longitudinal axis, the base including a rear end portion adjacent to the bore hole and a front end portion that is longitudinally spaced from the rear end portion and is adjacent to the rod rack;

an elongated boom assembly having a central axis of elongation, the boom assembly including a first end portion and a second end portion;

means for mounting the boom assembly to the base, said boom assembly mounting means mounting the boom assembly for movement relative to the base between a boom assembly rod release first position and a boom assembly rod pick up position;

a rod gripping assembly including first jaw means movable between a jaw mens rod gripping position and rod release position and the first power operated means for moving the first jaw means between the rod gripping and rod release positions;

an elongated arm member including a first end portion and a second end portion, the arm member second end portion being closer to the rod rack than the arm member first end portion when the gripping assembly is positioned adjacent to a rod in the rod rack;

first means for mounting the arm member first end portion to the boom assembly second end portion;

gripping assembly mounting means mounted to the arm member second end portion, the gripping assembly mounting means mounting the gripping assembly for limited free pivotal movement relative to the arm member about a gripping assembly axis which extends in a transverse direction relative to the base; and second power operated means for operatively moving the boom assembly and thereby moving the arm member to move the gripping assembly upwardly and longitudinally rearwardly relative to the base after the gripping assembly has been positioned adjacent to a rod in the rod rack and thence moving the gripping assembly into alignment with the bore hole central axis, said second power operated means being connected to at least one of the boom assembly and the boom assembly mounting means 9. The apparatus of claim 8 wherein said gripping assembly mounting means, in mounting the gripping assembly for pivotal movement, mounts the gripping assembly for movement between a gripping assembly datum position, in which the gripping assembly supports a grippingly engaged rod in substantial alignment with the bore hole when the boom assembly is in the boom assembly first position, and a gripping assembly second position during which the gripping assembly extends at an angle relative to the gripping assembly datum position that is greater in .a forward upward longitudinal direction relative to the base than when the boom assembly is in the boom assembly first position with the gripping assembly in its datum position and the;

the gripping assembly includes a jaw mount and a pivot mounted by the jaw mount, said pivot having a pivot axis that extends parallel to the bore hole axis when the gripping assembly is in its datum position and the boom assembly is in its first position, the first jaw means includes a first jaw pivotally mounted on the pivot for movement between a first jaw rod release position and a rod clamping position, the gripping assembly including operative clamping means that includes the first jaw means for rotating a rod to extend parallel to the pivot as the first jaw means is moved toward its rod clamping position in the event the rod is out of parallel alignment with pivot as the rod id being clampingly engaged, and the first power operated means includes means for moving the jaw between the rod release and clamping positions.

10. The apparatus of claim 9 wherein one of the clamping means and the jaw mount includes stop means for limiting the movement of the clamped rod toward the gripping assembly mounting means and at least in part causing the gripping assembly to pivot from the datum position to the gripping assembly second position as the gripping assembly is moved and operated and to permit free pivotal movement of the gripping assembly back to its datum position as the gripping assembly is moved away from the rack in the event the rod being gripping engaged extends longitudinally upwardly relative to the base at an angle to have the rod lower end be further longitudinally rearwardly than the intersection of the pivot axis of the pivot with the base when the gripping assembly is adjacent to the stack and the jaw is pivoted to its rod clamping position.

11. The apparatus of claim 9 wherein the means for moving the boom assembly includes third power operated means for pivotally moving the boom assembly first end portion about an axis that extends in a transverse direction relative to the base and fourth power operated means for moving the boom assembly lower end portion transversely relatively to the base.

12. The apparatus of claim 9 wherein said gripping assembly mounting means includes a horizonal pivot mounted by the arm member, said horizonal pivot having a pivot axis extending transversely relative to the base, third means pivotally mounted by the transverse pivot for mounting the jaw mount, the gripping assembly extending longitudinally forward of the transverse pivot and, in combination with the jaw mount, being of a weight to constantly urge the gripping assembly to move toward the gripping assembly datum position, and a stop member mounted by the third means for limiting the movement of the gripping assembly from the gripping assembly second position to the gripping assembly datum position.

13. Rod handler apparatus according to claim 9 wherein the operative means includes a second jaw, each of the jaws including a finger portion extending generally longitudinally forwardly of the jaw mount and a generally vertical first planar surface for cooperatively clampingly abutting against a drill rod when the first jaw is in its rod clamping position, the first planar surfaces of the jaw finger portions converging from one another in a direction longitudinally away from the jaw mount in the rod release position and in the rod clamping position diverging from one another in a direction longitudinally toward the jaw mount.

14. Rod handler apparatus according to claim 13 wherein each of the jaws has a front edge that is of a dimension many times smaller than the outer diameter of the drill rod and a vertical surface that diverges from the respective jaw abutting surface in a direction toward the jaw mount to facilitate pushing rods in the drill rack away from the rod to be clampingly engaged.

15. The apparatus of claim 8 wherein the gripping assembly includes a jaw mount and a pivot mounted by the jaw mount, said pivot having a pivot axis that is parallel to the boom assembly axis when the boom assembly is in its first position, and the jaw means includes a first pivotally mounted on the pivot for movement between a rod release position and a rod clamping position.

* * * * *

UNITED STATES PATENT AND TRADEMARK OFFICE

CERTIFICATE OF CORRECTION

PATENT NO. : 5,183,366

DATED : 02/02/1993

INVENTOR(S) : Ivor N. Paech

It is certified that error appears in the above-identified patent and that said Letters Patent is hereby corrected as shown below:

Column 1, line 34, change "depending" to --dependingly--.
Column 2, line 13, change "parallely" to --parallelly--.
Column 3, line 19, change "plateform" to --platform--; line 57, change "showinging" to --showing--; and line 61, change "clock" to --block--.
Column 8, line 11, change "surface," to --surfaces--.
Column 13, line 54, change "mens" to --means--; and line 55, before "rod", insert --a--.
Column 14, line 61, change "gripping" to --grippingly--
Column 16, line 21, after "first", insert --jaw--.

Signed and Sealed this

Fourteenth Day of December, 1993

*Attest:*

*Attesting Officer*

BRUCE LEHMAN

*Commissioner of Patents and Trademarks*